US009966037B2

(12) United States Patent
Malik

(10) Patent No.: US 9,966,037 B2
(45) Date of Patent: May 8, 2018

(54) METHOD AND SYSTEM FOR FACILITATING MODIFICATION OF TEXT COLORS IN DIGITAL IMAGES

(75) Inventor: Amal Z Malik, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 547 days.

(21) Appl. No.: 13/545,025

(22) Filed: Jul. 10, 2012

(65) Prior Publication Data

US 2014/0016151 A1 Jan. 16, 2014

(51) Int. Cl.
*G09G 5/02* (2006.01)

(52) U.S. Cl.
CPC ..... *G09G 5/026* (2013.01); *G09G 2358/00* (2013.01)

(58) Field of Classification Search
CPC .... G09G 5/02; G09G 2340/0407; G09G 5/06; G09G 5/026; G06T 5/40; H04N 1/6058; H04N 1/40012; H04N 1/60; H04N 1/628; H04N 1/00427; G06K 9/4652
USPC ..... 358/1.9, 2.1, 3.01, 501, 518, 522; 382/165, 166, 167, 170; 345/590, 593, 345/594, 600, 601, 602, 605
See application file for complete search history.

(56) References Cited

U.S. PATENT DOCUMENTS

| | | | | |
|---|---|---|---|---|
| 2003/0011607 | A1* | 1/2003 | Spaulding et al. | 345/581 |
| 2006/0001690 | A1* | 1/2006 | Martinez | B41J 29/393 347/19 |
| 2007/0146754 | A1* | 6/2007 | Chang | 358/1.9 |
| 2009/0284780 | A1* | 11/2009 | Kitora et al. | 358/1.13 |
| 2010/0215261 | A1* | 8/2010 | Kim et al. | 382/165 |
| 2011/0069885 | A1* | 3/2011 | Malik et al. | 382/176 |
| 2012/0050828 | A1* | 3/2012 | Ohk | 358/518 |
| 2012/0203371 | A1* | 8/2012 | Hsu | 700/138 |

* cited by examiner

*Primary Examiner* — Jamares Q Washington

(74) *Attorney, Agent, or Firm* — Jones Robb PLLC

(57) ABSTRACT

A Graphical User Interface (GUI) is provided for facilitating modification of text colors in a digital image. In an embodiment, the GUI includes a first user interface adapted to display a selectable first set of text colors to appear in a modified digital image. In another embodiment, the GUI includes a second user interface adapted to display a selectable first set of text colors to appear in a modified digital image. In yet another embodiment, the GUI includes various options to facilitate securing of confidential data in the digital image.

1 Claim, 15 Drawing Sheets

METHOD AND SYSTEM FOR FACILITATING MODIFICATION OF TEXT COLORS IN DIGITAL IMAGES

COPYRIGHT NOTICE

A portion of the disclosure of this patent document contains material that is subject to copyright protection. The copyright owner has no objection to facsimile reproduction of any one of the patent documents, or the patent disclosure, as it appears in the Patent and Trademark Office patent file or records. Otherwise all copyright rights are reserved.

TECHNICAL FIELD

The presently disclosed embodiments are related to processing of digital images. More particularly, the presently disclosed embodiments are related to a technique of modifying text colors in digital images.

BACKGROUND

Most of the existing Multi-Function Devices (MFDs) offer an N-layer Mixed Raster Content (MRC) compression or any other similar techniques for better text quality and lower file sizes. The N-layer MRC compression technique allows the separation of text and pictorial part of the image into separate layers. The pictorial part of the image goes into a continuous tone background layer and is compressed using any continuous tone compression technique such as JPEG. While the text layers are extracted into N binary layers based on color and spatial proximity of text regions in a scanned image. These N binary text layers are compressed using any lossless binary compression scheme such as G4, JBIG2 to gain good text quality for better OCR accuracy. Ideally, MRC should extract all the text regions in an image. However, MRC compression technique has various shortcomings which include, but are not limited to, jaggy text and undesired changes of text colors in the scanned documents (i.e., digital images). Jaggy text is a result of text being dropped into the background plane when it is not extracted into one of the binary N layers. In certain scenarios, an attempt to extract all the text into one of the N binary layers to fix the jaggy text problem for achieving better OCR can cause further undesired text color changes. Such unanticipated color changing of text is a major cause of customer complaints.

SUMMARY

According to embodiments illustrated herein, there is provided a graphical user interface (GUI) for facilitating modification of text colors in digital image. The GUI includes a first user interface adapted to display an option to input a number of text colors to appear in a modified digital image.

According to embodiments illustrated herein, there is provided a GUI for facilitating modification of text colors in a digital image. The GUI includes a second user interface adapted to display a selectable first set of text colors to appear in a modified digital image.

According to embodiments illustrated herein, there is provided a method for facilitating modification of text colors in a digital image. The method is implementable on a computing device. The method includes displaying an option to input a number of text colors on a display associated with the computing device. An input defining the number of text colors is received. The document is then scanned to generate a digital image. The digital image is then further processed to generate a modified digital image so that the modified digital image includes text with the defined number of text colors.

According to embodiments illustrated herein, there is provided an MFD including a display, an image scanning, and an image processing module. The display is adapted to display an option to input a number of text colors. The image scanning module is adapted to generate a digital image from a document. The image processing module is adapted to generate a modified digital image from the digital image so that the modified digital image includes text with only the defined number of text colors.

According to embodiments illustrated herein, there is provided a GUI for facilitating securing of confidential data in a digital image. The GUI comprises a user interface adapted to display an option to select one or more text colors associated with the confidential data. The user interface is further adapted to display one or more selectable options to facilitate one of hiding, masking, or elimination of the confidential data.

According to embodiments illustrated herein, there is provided a method for securing confidential data in a digital image. The method includes receiving an input for selecting one or more text colors associated with the confidential data. One or more selectable options to facilitate one of hiding, masking, or elimination of the confidential data are then displayed. Thereafter, the digital image is processed to hide, mask, or eliminate the confidential data based on the selection of an option from the one or more selectable options.

BRIEF DESCRIPTION OF DRAWINGS

The accompanying drawings illustrate various embodiments of systems, methods, and embodiments of various other aspects of the invention. Any person having ordinary skills in the art will appreciate that the illustrated element boundaries (e.g., boxes, groups of boxes, or other shapes) in the figures represent one example of the boundaries. It may be that in some examples, one element may be designed as multiple elements or that multiple elements may be designed as one element. In some examples, an element shown as an internal component of one element may be implemented as an external component in another, and vice versa. Furthermore, elements may not be drawn to scale.

Various embodiments will hereinafter be described in accordance with the appended drawings, which are provided to illustrate, and not to limit the scope in any manner, wherein like designations denote similar elements, and in which.

DETAILED DESCRIPTION

Figure 1:
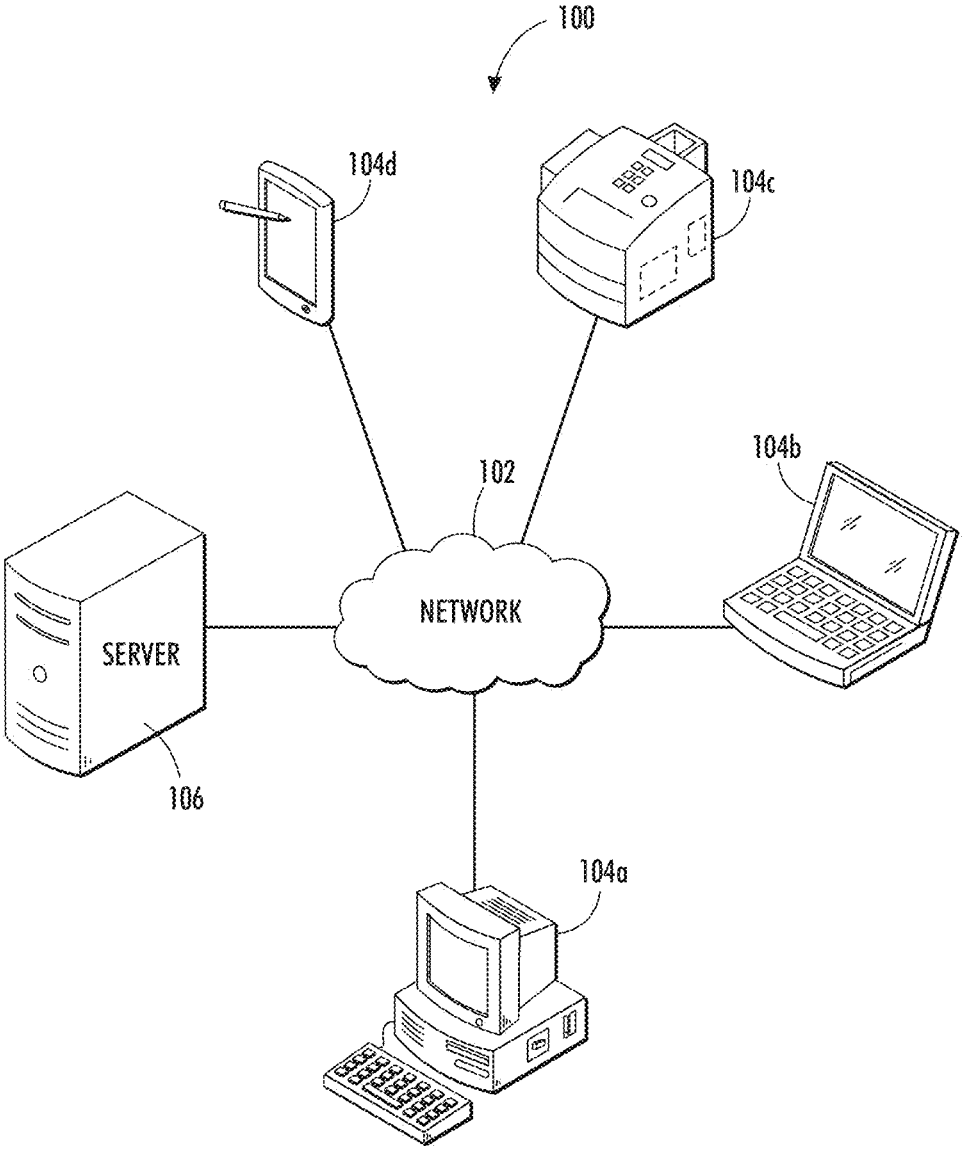
FIG. 1 is a block diagram illustrating an environment in accordance with at least one embodiment.

The present disclosure is best understood with reference to the detailed figures and description set forth herein. Various embodiments are discussed below with reference to the figures. However, those skilled in the art will readily appreciate that the detailed descriptions given herein with respect to the figures are simply for explanatory purposes as methods and systems may extend beyond the described embodiments. For example, the teachings presented and the needs of a particular application may yield multiple alternate and suitable approaches to implement functionality of any detail described herein. Therefore, any approach may extend beyond the particular implementation choices in the following embodiments described and shown.

References to "one embodiment", "an embodiment", "one example", "an example", "for example" and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

Definitions: The following terms shall have, for the purposes of this application, the respective meanings set forth below.

A "multifunction device" (MFD) refers to a device that can perform multiple functions. Examples of the functions include, but are not limited to, printing, scanning, copying, faxing, emailing, and the like.

A "digital image" refers to a collection of data, including image data in any format, retained in an electronic form. The digital image can contain one or more pictorial, symbols, text, line art, blank, or non-printed regions etc. In an embodiment, examples of the digital image include, but are not limited to, various bank account forms, bills, an e-ticket, a hotel reservation form, a boarding pass, student examination papers, various insurance forms, e-statements corresponding to banking, and credit cards. In an embodiment, the digital image is obtained by scanning a corresponding physical document. The digital image can be stored in various file formats, such as, JPG or JPEG, GIF, TIFF, PNG, BMP, RAW, PSD, PSP, PDF, and the like.

A "computing device" refers to a computer, a device including a processor/microcontroller and/or any other electronic component, or a device or a system that performs one or more operations according to one or more programming instructions. Examples of the computing device include, but are not limited to, a desktop computer, a laptop, a personal digital assistant (PDA), a smart-phone, an MFD, a tablet computer (e.g., iPad®, Samsung Galaxy Tab®) and the like. The computing device is capable of accessing (or being accessed over) a network (e.g., using wired or wireless communication capabilities).

A "network" refers to a medium that interconnects various computing devices and server. Examples of the network include, but are not limited to, LAN, WLAN, MAN, WAN, and the Internet. Communication over the network may be performed in accordance with various communication protocols such as Transmission Control Protocol and Internet Protocol (TCP/IP), User Datagram Protocol (UDP), and IEEE 802.11n communication protocols.

"Scanning" refers to a technique of recording an image as digital data in any format, thereby creating a file.

"Graphical User Interface" OR "GUI" refers to an interface that facilitates a user to interact with associated computing devices. The user can interact with the GUI using various input mediums/techniques including, but not limited to, a keypad, mouse, joystick, any touch-sensitive medium (e.g., a touch-screen or touch sensitive pad), voice recognition, gestures, video recognition, and so forth. In embodiment, the GUI can be displayed on a touch-screen and the user can interact with the GUI using the touch-screen. In an embodiment, the GUI is a Local User Interface (LUI), i.e., displayable on a local display of an MFD or an image-scanning equipment. In an embodiment, the GUI is a Remote User Interface (RUI), i.e., displayable on a display of any computing device connected to the MFD or the image-scanning equipment. In an embodiment, the GUI is Web User Interface (WUI), i.e., displayable on a web-page.

An "Optical Character Recognition" or "OCR" operation refers to conversion of scanned images of handwritten, typewritten, or printed text into machine-encoded text.

"Mixed Raster Content" or "MRC" or "N-Layer MRC" refers to a method/technique/operation for compressing compound images (e.g., images containing text, image data, various shapes, symbols, and so forth). By applying the MRC method, a compound image is converted to an image having multiple layers/planes depending on the content in the compound image. The layers are then compressed using suitable techniques. In an embodiment, the number of text layers can be from 1 to N. Usually, N is kept to 256 for an optimal file size of the resultant image. However, any number of layers can also be possible without limiting the scope of the ongoing description.

In an embodiment, a "first processed digital image" refers to a digital image obtained after applying the one or more image processing techniques such as, MRC operation or any other suitable text extraction operations, such as, image segmentation, auto windowing techniques on the digital image (e.g., scanned document). In an embodiment, the first processed digital image includes different layers as discussed above.

FIG. 1 is a block diagram illustrating an environment 100 in accordance with at least one embodiment. Various embodiments of the methods and systems for modifying text colors in a digital image are implementable in the environment 100. The environment 100 includes a network 102 and a server 106. The environment further includes a desktop computer 104*a*, a laptop 104*b*, an MFD 104*c*, and a tablet computer 104*d* (hereinafter referred to as computing devices 104). Although FIG. 1 shows only four computing devices for simplicity, it may be appreciated that the disclosed embodiments can be implemented for a large number of computing devices including, but not limited to, smartphones, PDAs, and various similar handheld devices.

A user operating the desktop computer 104*a*, the laptop 104*b*, or tablet computer 104*d* is capable of accessing the MFD 104*c* and/or the server 106 through the network 102. A functionality of modifying text colors in digital images can be implemented on at least one of the desktop computer 104*a*, the laptop 104*b*, the MFD 104*c*, the tablet computer 104*d*, and the server 106. In an embodiment, for example, the desktop computer 104*a* and/or the laptop 104*b* are capable of executing an application for modifying text colors in the digital images. In another embodiment, the application is hosted by the server 106 and the desktop computer 104*a*, tablet computer 104*d*, and/or the laptop 104*b* are capable of accessing the application over the network 102. In another embodiment, the MFD 104*c* or any of the computing devices in 104 is adapted to facilitate an OCR operation.

Figure 2:
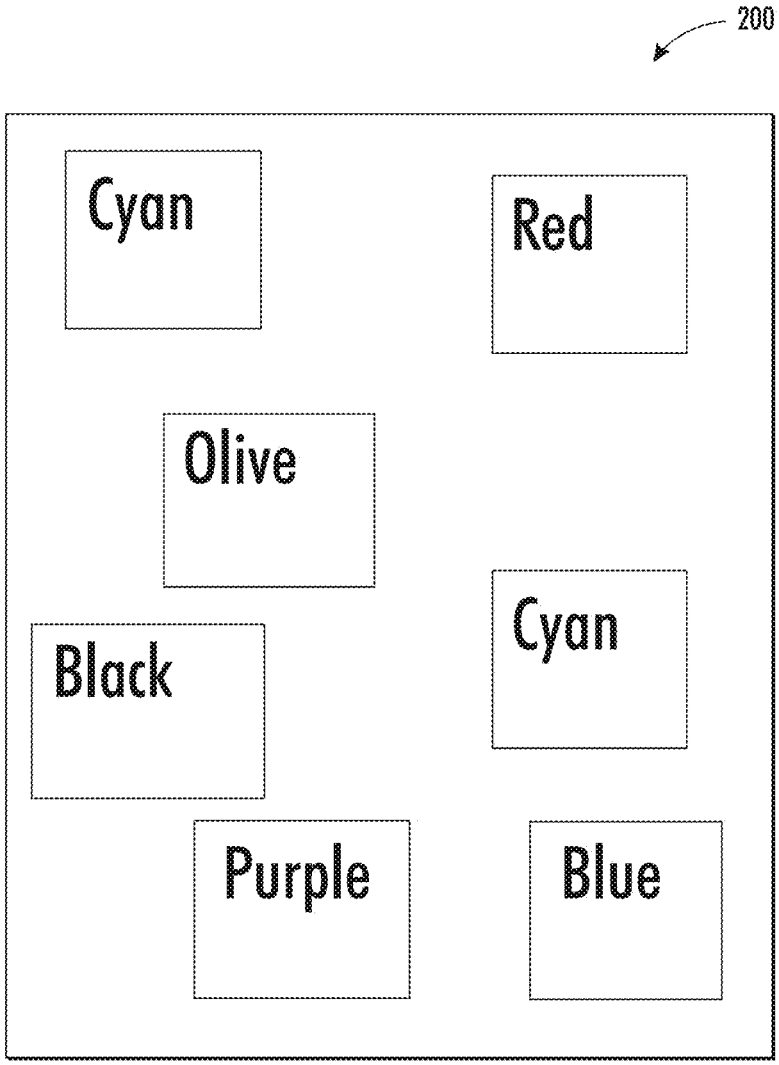
FIG. 2 depicts a first processed digital image in accordance with at least one embodiment.

FIG. 2 depicts a first processed digital image 200 in accordance with at least one embodiment. The first processed digital image 200 contains text in different text colors, such as cyan, red, olive, black, purple, and blue (not observed visually from FIG. 2). The rectangular regions show the N text layers sizes and their placement in the First processed digital image.

FIG. 3*a*-3*g* depict various GUIs (300*a*-300*g*) in accordance with various embodiments.

Figure 3A:
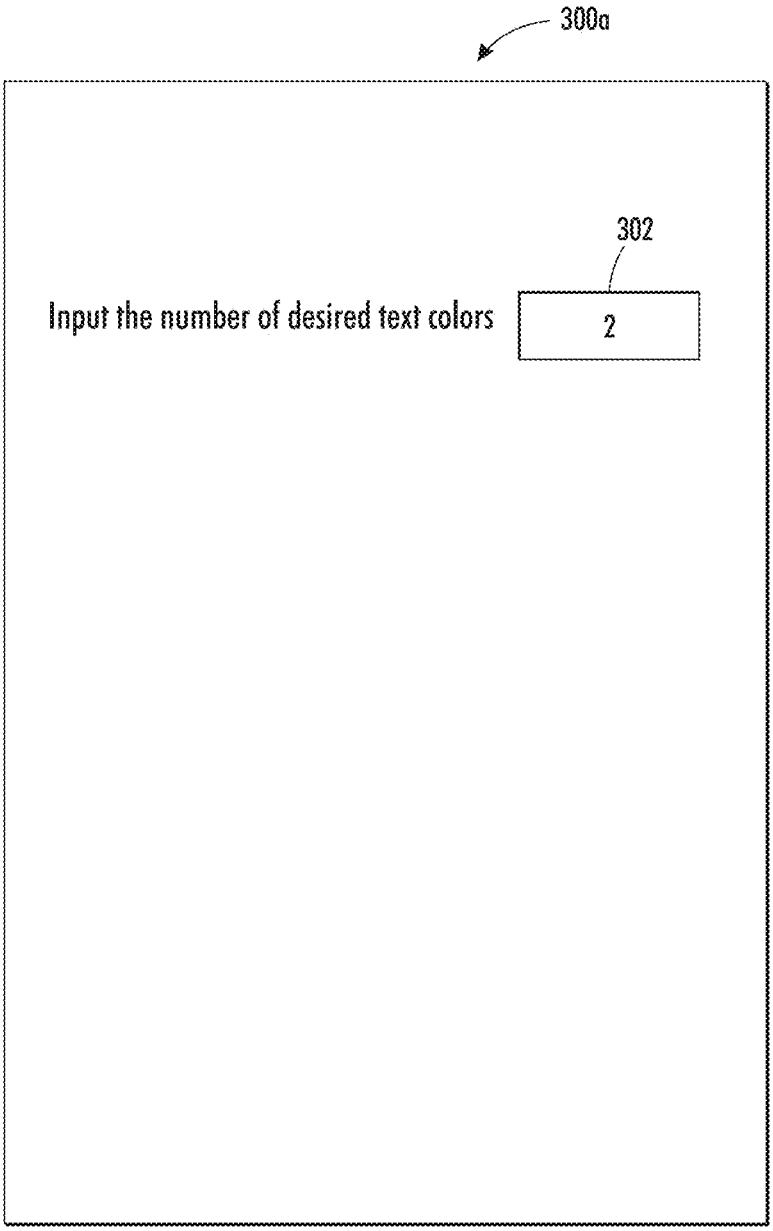
FIG. 3*a*-3*g* depict various GUIs in accordance with various embodiments.

FIG. 3*a* depicts the GUI 300*a* in accordance with an embodiment. The GUI 300*a* displays a first user interface including an option 302 to input a number of text colors. Once the number of text colors is inputted, a corresponding modified digital image will contain only the user specified number of text colors. Various examples of the option 302 include, but are not limited to, a text box, a drop-down list, radio buttons, or a scale for defining the number of text colors.

Figure 3B:
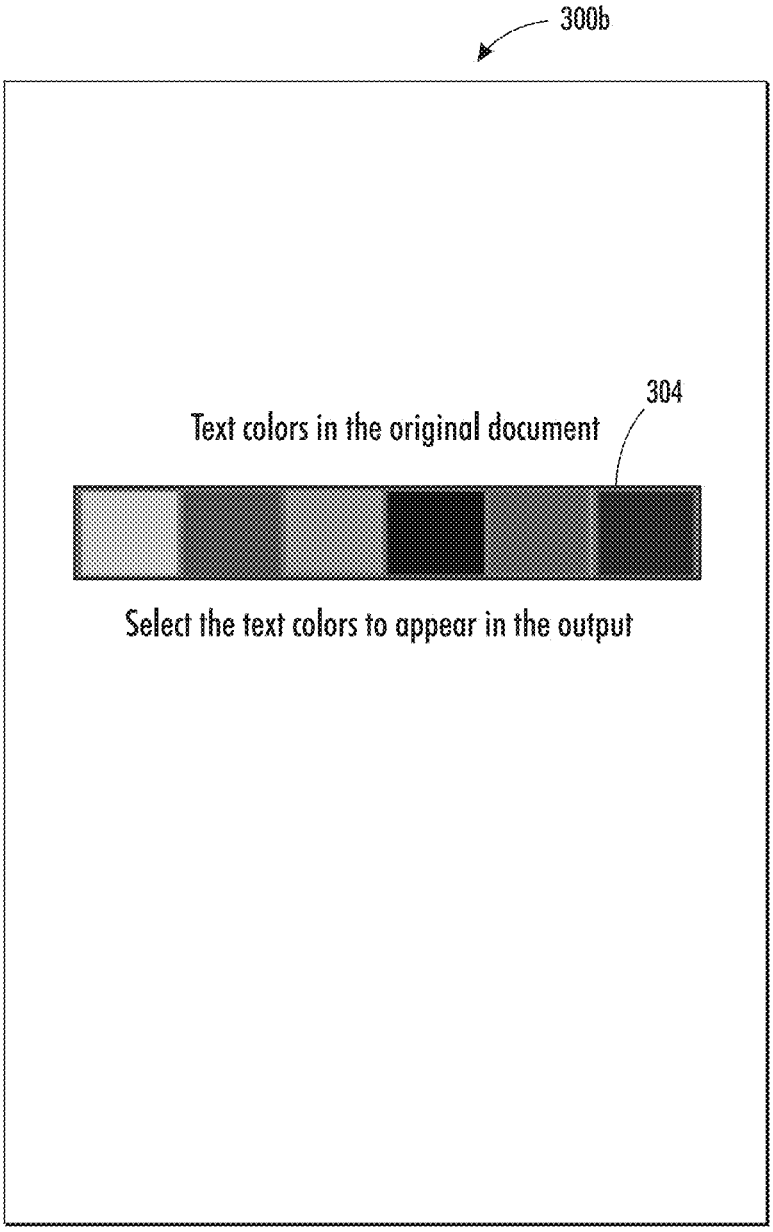

FIG. 3*b* depicts the GUI 300*b* in accordance with an embodiment. The GUI 300*b* displays a second user interface including an option 304 to facilitate the selection of text colors. Once the text colors are selected, a corresponding modified digital image will contain only the selected number of text colors. In an embodiment, the text colors in the option 304 are determined based on the text colors present in the first processed digital image 200 corresponding to the document. In another embodiment, the text colors in the option 304 are randomly determined. In another embodiment, the option 304 includes a predefined set of colors.

Figure 3C:
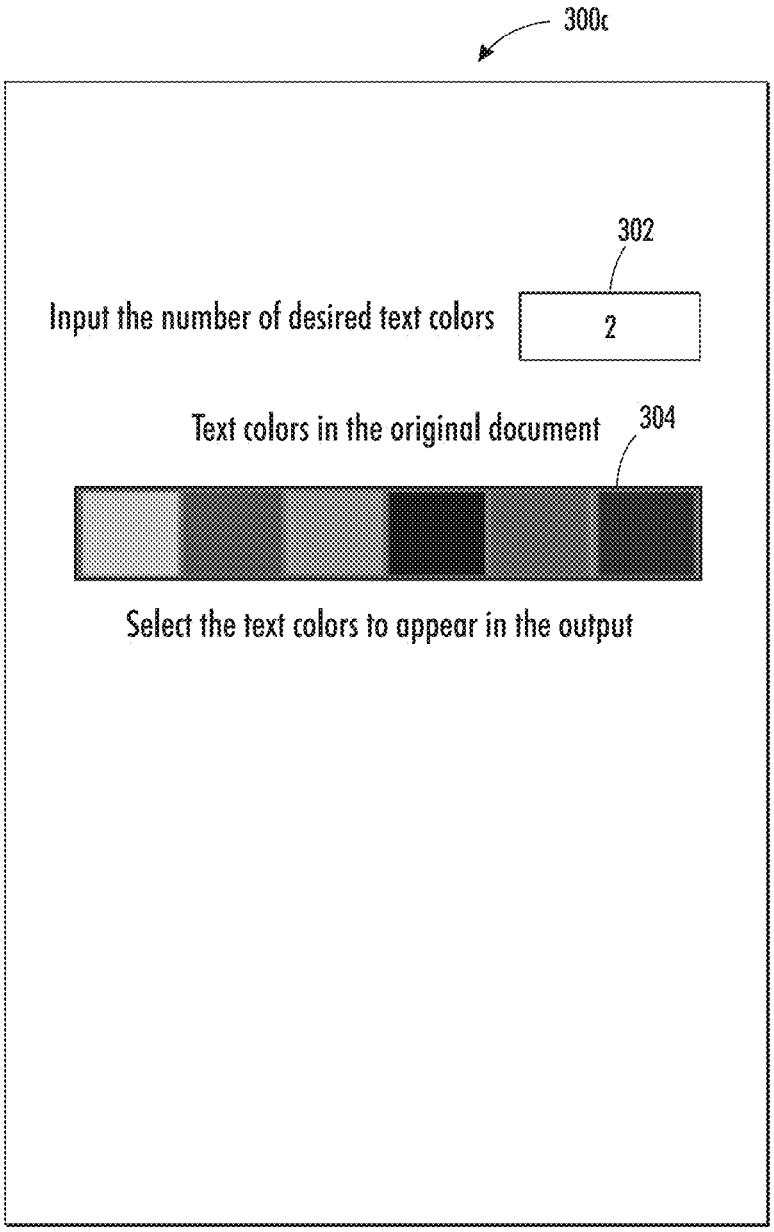

FIG. 3*c* depicts the GUI 300*c* in accordance with an embodiment. The GUI 300*c* displays both the first user interface and the second user interface including the options 302 and 304. In an embodiment, the option 304 is displayed when the user defines the number of text colors. The GUI 300*c* enables the user to input the number of text colors (using the option 302) as well as select the text colors to be contained in the modified digital image (using the option 304). For example, if the user inputs 2 in the option 302 then he/she can also select two text colors from the option 304.

In an embodiment, the option 304 in the GUI 300*b* or the GUI 300*c* is displayed in response to the user inputting the number of text colors in the GUI 300*a*. So, in this case, in an embodiment, if there is a mismatch between the number of text colors entered using the option 302 and the colors selected from the option 304 (i.e., if the user selects different number of text colors from the option 304 than the number inputted using the option 302), an error/warning message will be displayed to the user. In another embodiment, the user will be disabled from selecting the any additional number of text colors from the option 304 than entered in the GUI 300*a*.

Figure 3D:
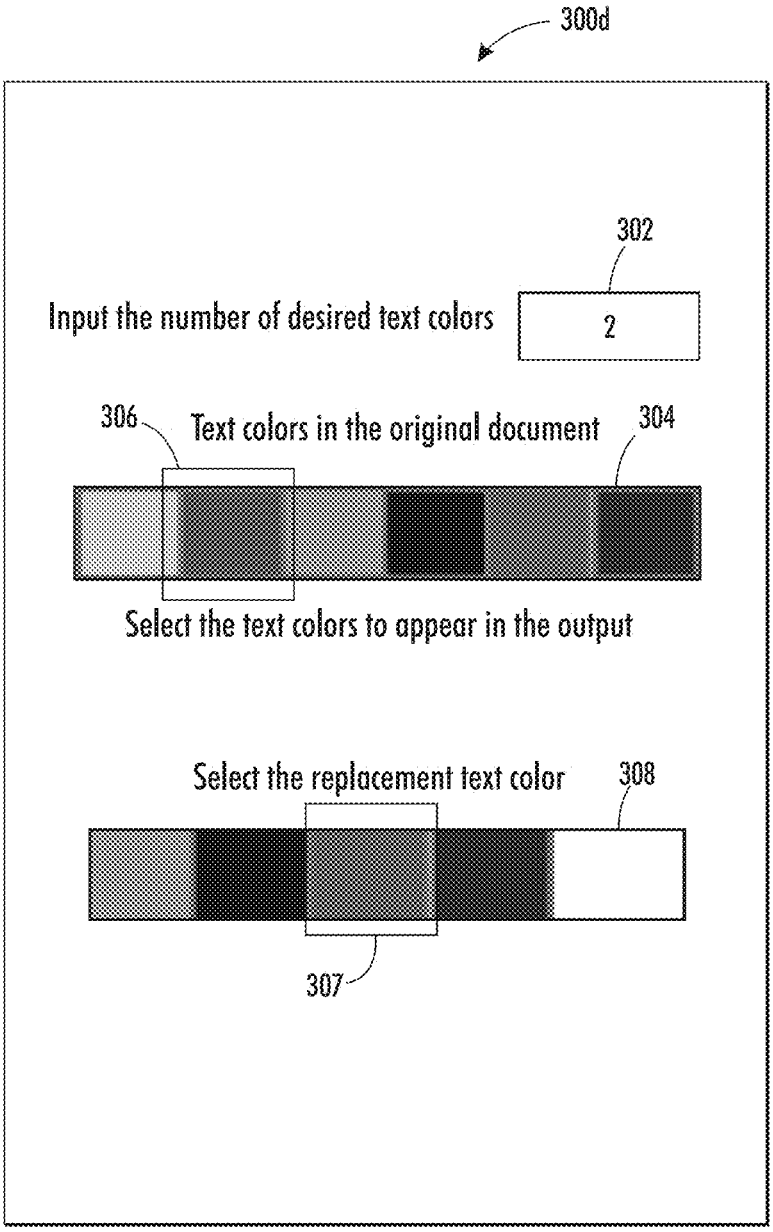

FIG. 3*d* depicts the GUI 300*d* in accordance with an embodiment. The GUI 300*d* displays a third user interface containing a replacement text color option 308 for replacing the selected text colors in the option 304. In an embodiment, the replacement text color option 308 is displayed in response to the selection of any text color from the option 304. For example, if the user selects a text color (e.g., red) shown in a selection 306, the replacement text color option 308 containing various replacement options for that text color will be displayed. The user can then select any text color (e.g., a text color, such as olive shown by a selection 307) from the replacement text color options in the replacement text color option 308. Thus, for example, a red color text will be converted into an olive color text to obtain a corresponding modified digital image. Similarly, the GUI 300*d* facilitates selection of the replacement text colors for a number of "M" text colors selected from the option 304, where "M" is the total number (e.g., inputted using the option 302) of desired text colors in the modified image.

In an embodiment, the various text colors in the replacement text color option 308 are subset of the text colors present in the First processed digital image (or the digital image). In another embodiment, the various text colors in the replacement text color option 308 are random colors. In another embodiment, the various text colors in the replacement text color option 308 are predefined.

Figure 3E:
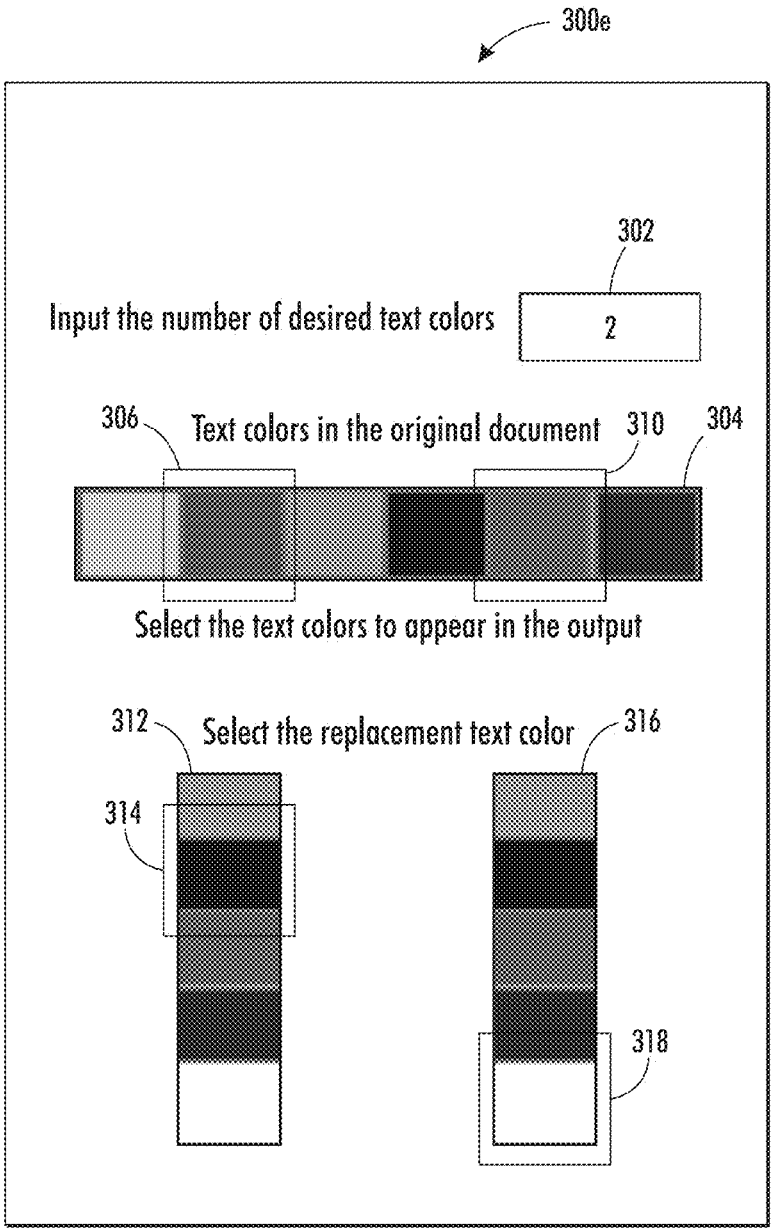

FIG. 3*e* depicts the GUI 300*e* in accordance with an embodiment. The GUI 300*e* displays replacement text color options 312 and 316 for defining replacement text colors for the selected text colors in the option 304. A separate option of text colors will be displayed for each of the text colors selected in the option 304. For example, if the user selects red and purple colors (shown by the selections 306 and 310 respectively) from the option 304, the replacement text color options 312 and 316 are displayed. The replacement text color option 312 corresponds to the selection 306 and the replacement text color option 316 corresponds to the selection 310, with 314 and 318 being the selected replacement text colors for 306 and 310 in this example. Thus, the GUI 300*e* facilitates the user to select replacement text colors for the selected text colors (e.g., the text colors selected from the option 304) simultaneously.

In an embodiment, the replacement text color options 308, 312, and 316 include white color to facilitate a data security feature. So, when the user selects the white color from the replacement text color options 308, 312, and 316, the corresponding text color (e.g., the text color to be replaced) is replaced to the white color and the associated text becomes invisible for typical office documents that have a uniform white background.

In another embodiment, the replacement text color options 308, 312, and 316 may also include a background color present in the first processed digital image to facilitate the data security feature. So, when the user selects the background color from the replacement text color options 308, 312, and 316, 308, the corresponding text color (e.g., the text color to be replaced) is replaced to the background color and the associated text becomes invisible in case of documents with a uniform non-white background.

Figure 3F:
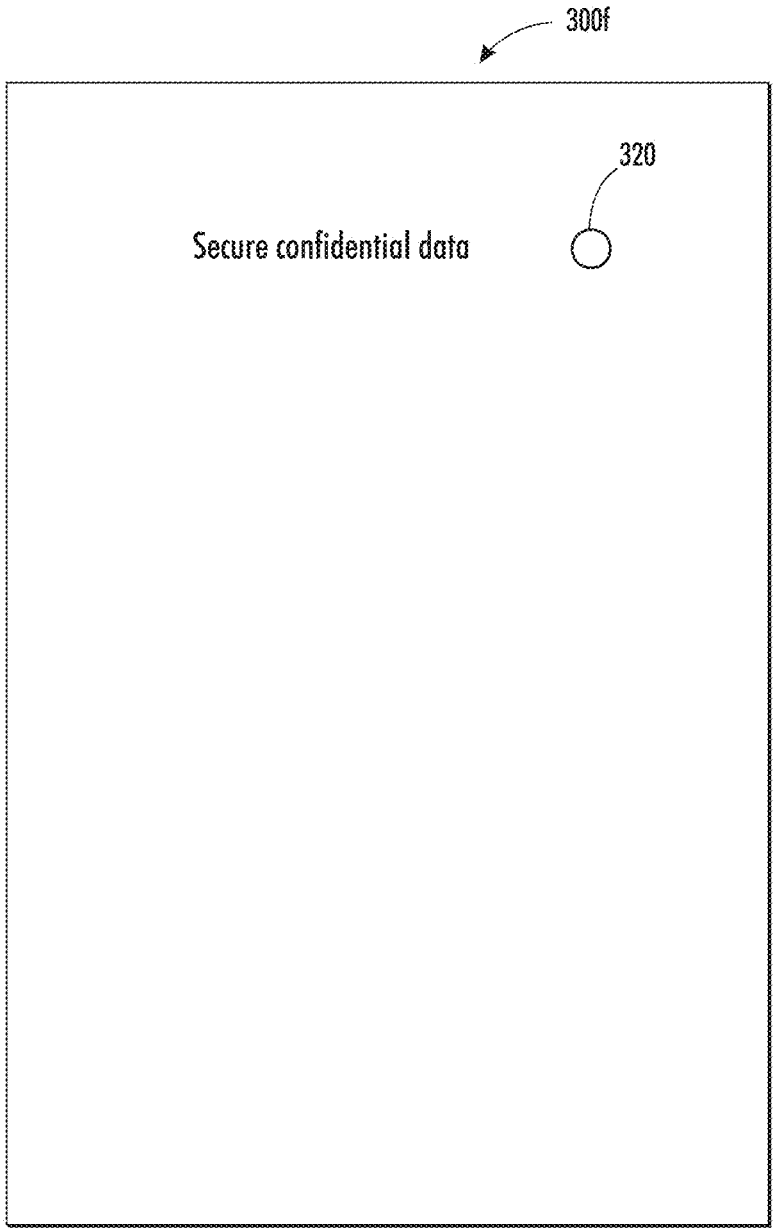

FIG. 3*f* depicts the GUI 300*f* in accordance with an embodiment. The GUI 300*f* facilitates the data security feature for securing any confidential data in the document. The GUI 300*f* includes a security option 320. Various example of the security option 320 include, but are not limited to, a radio button, a drop-down list offering "YES" and "NO" selections, a checkbox, and so forth. The data security feature is further explained in the description infra.

Figure 3G:
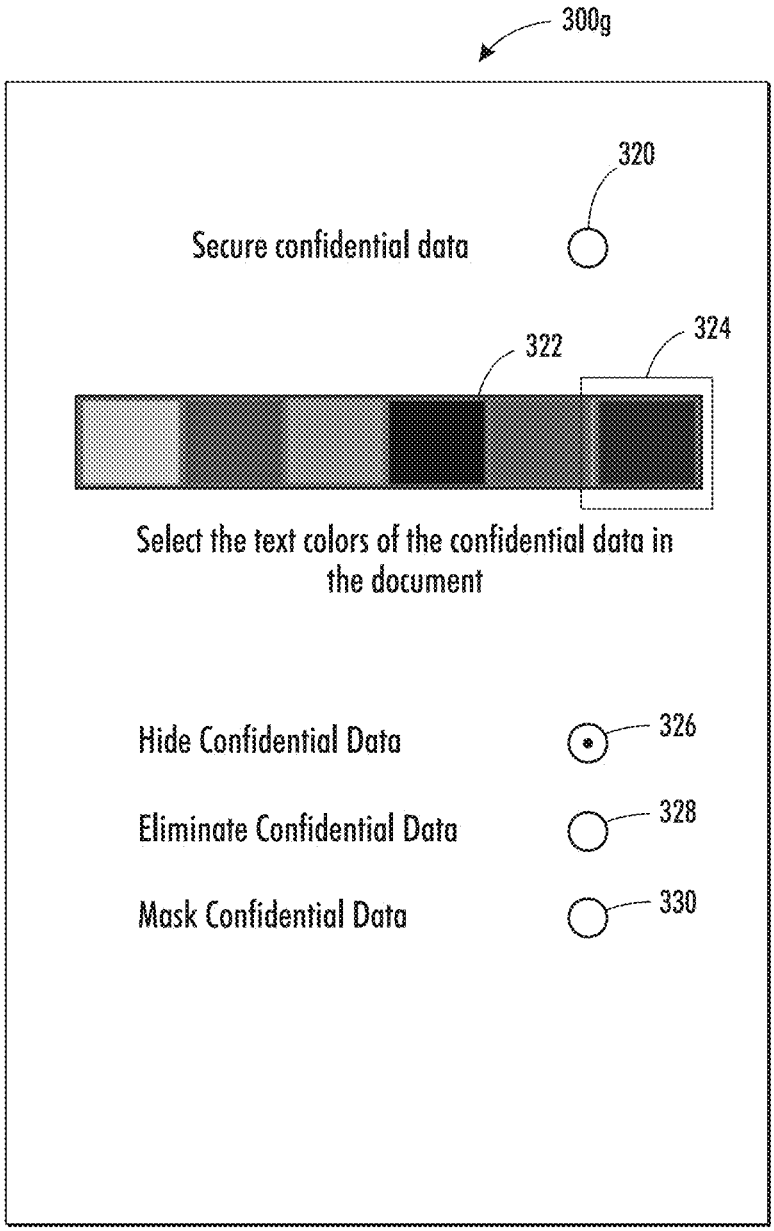

FIG. 3*g* depicts the GUI 300*g* in accordance with an embodiment. When the user activates the security option 320 (in the GUI 300*f*), a security text color selection option 322 appears. In another embodiment, the GUI 300*g* can appear independent of the GUI 300*f* (i.e., independent of the activation/deactivation of the security option 320) or the GUI 300*g* may not contain the security option 320. The security text color selection option 322 facilitates the user to select one or more text colors that are associated with confidential information that the user wants to secure. In an embodiment, the text colors in the security text color selection option 322 correspond to the text colors contained in the first processed digital image 200 (refer FIG. 2).

Further, an option 326 for hiding the confidential data is displayed. Furthermore, an option 328 for eliminating the confidential data is displayed. In an embodiment, the options 326 and 328 are displayed in response to the selection of text colors from the security text color selection option 322. In another embodiment, the options 326 and 328 are displayed simultaneously with security text color selection option 322 when the user activates the security option 320.

In an embodiment, an option 330 for masking the confidential data is presented on the GUI 300*g*. By activating the option 330, the text associated with the confidential data in the first processed digital image will be masked with a predefined color.

Although, the options 326, 328, and 330 are shown as radio buttons, it is understood by a person having ordinary skills in the art that any other type of selection options including, but not limited to, drop-down list, vertical or horizontal selectable list, and the like can be used to represent the options 326, 328, and 330 without departing from the scope of the ongoing description.

Figure 4:
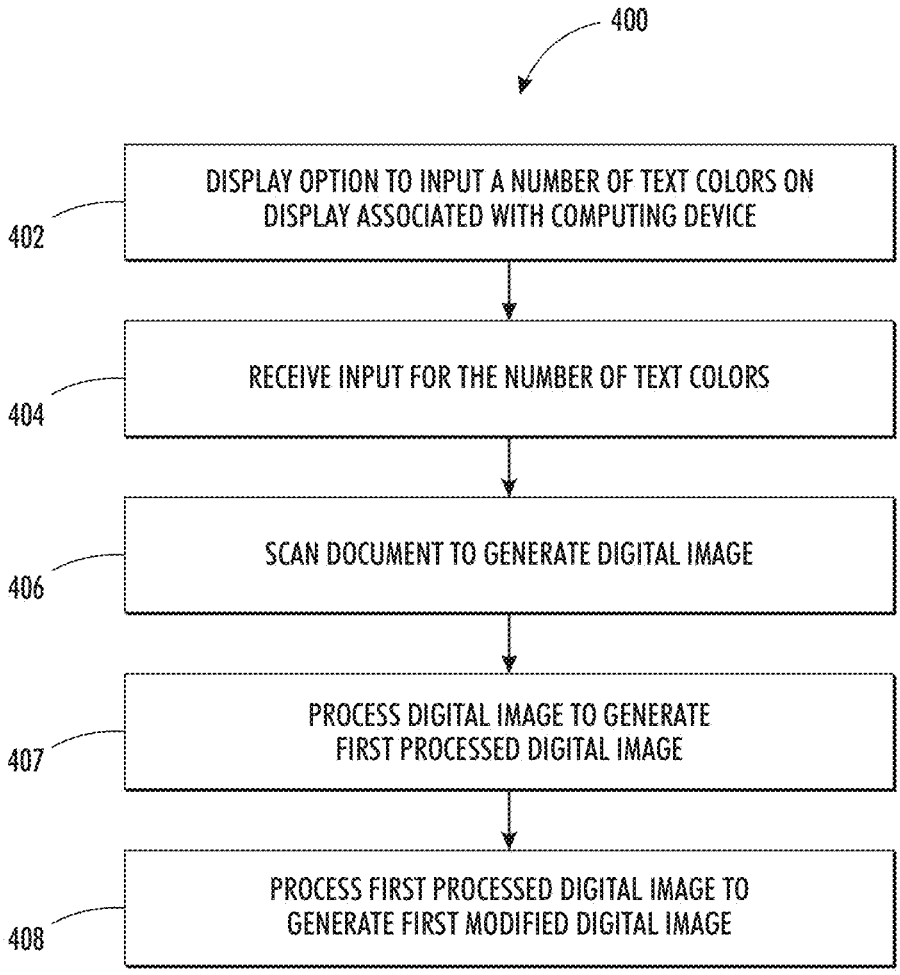
FIG. 4 is a flow diagram illustrating a method for modifying and limiting the number of text colors in a digital image in accordance with at least one embodiment.

FIG. 4 is a flow diagram 400 illustrating a method for modifying and limiting the number of text colors in the digital image in accordance with at least one embodiment.

At step 402, the option 302 to input the number of desired text colors in the first modified digital image is displayed on a display of associated one or more computing devices 104. In an embodiment, a GUI such as the GUI 300*a* is displayed on the display.

At step 404, an input for the desired number of text colors in the modified digital image is received. In an embodiment, the user selects the number of text colors to appear in the first modified digital image using the option 302. In an embodiment, the user types the number. In another embodiment, the user selects the number from a drop-down list of pre-defined numbers. For example, a drop-down list with the numbers 2, 3, 4, and 5 is displayed in the GUI 300*a* as the option 302. In another embodiment, the user selects the number text colors from a numeric scale.

At step 406, the document is scanned to generate the digital image.

At step 407, the digital image is processed to generate the first processed digital image (such as, the first processed digital image 200). In an embodiment, the MRC operation (such as, the N-Layer MRC operation) is first performed on the digital image to generate the first processed digital image from the digital image. In another embodiment, any other suitable text extraction operations/techniques can also be performed to generate the first processed digital image from the digital image.

At step 408, the first processed digital image is further processed to generate the first modified digital image. The first processed digital image is processed to generate the first modified digital image such that the first modified digital image includes only the desired number of text colors inputted at step 402. For example, if the user defines two text colors, then the first processed digital image is further processed such that the first modified digital image contains only two text colors. In an embodiment, the text colors are determined based on a histogram analysis of the text colors present in the first processed digital image.

Figure 5:
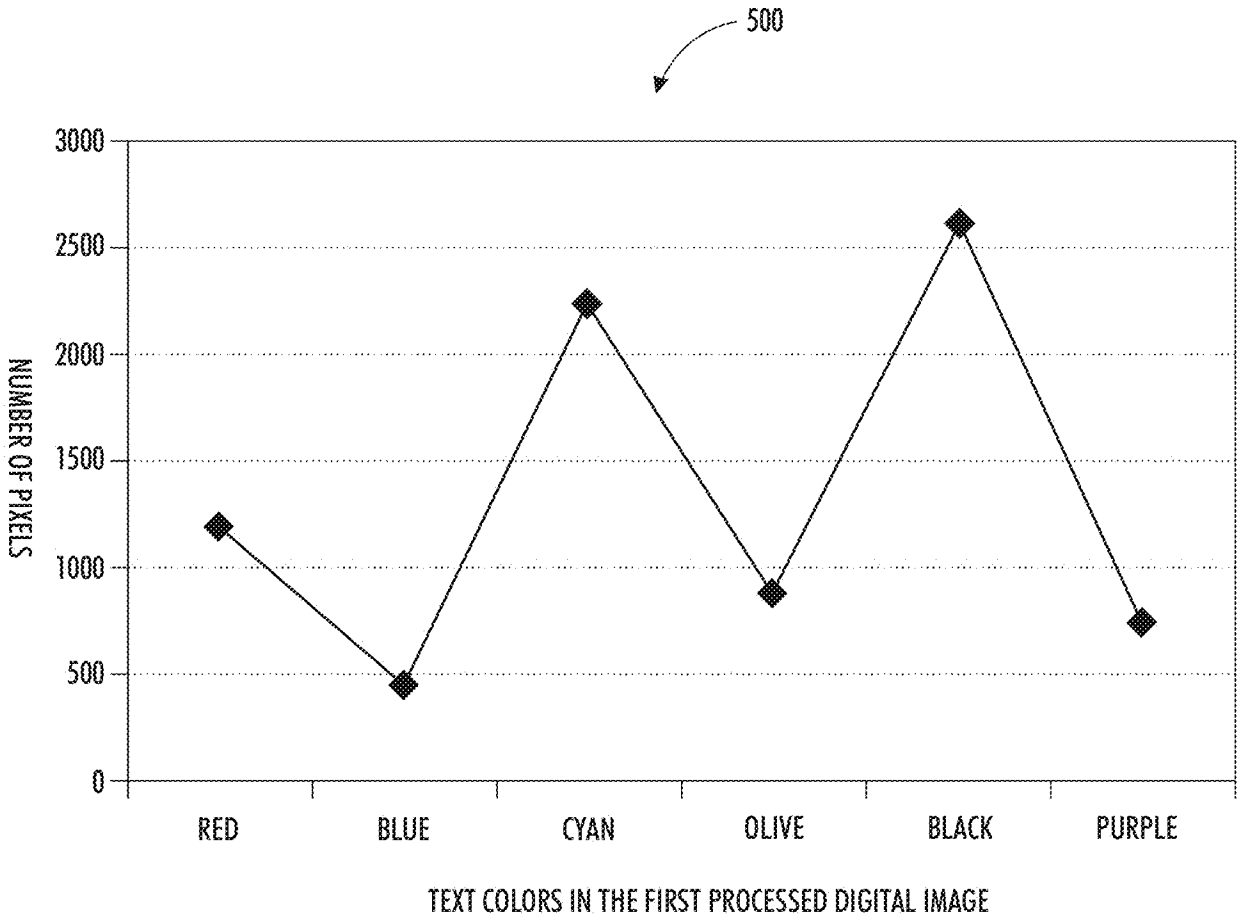
FIG. 5 depicts a chart illustrating a histogram analysis for the text colors present in a first processed digital image.

FIG. 5 depicts a chart 500 illustrating a histogram analysis for the text colors present in the first processed digital image 200. The X-axis in the chart 500 represents various text colors present in the first processed digital image. The Y-axis in the chart 500 represents number of text pixels corresponding to each of the text colors in the N layers of MRC in the first processed digital image 200.

In an embodiment, the text colors with the highest histogram values are selected to appear in the first modified digital image. For example, it is depicted from the chart 500 that the cyan and black text colors have higher histogram values as compared to other text colors in the first processed digital image 200. Thereafter, the text of other text colors is converted into the text colors having highest histogram values (e.g., cyan and black). However, any other text colors can also be selected to appear in the first modified digital image without departing from the scope of the ongoing description.

In an embodiment, the text colors are randomly selected to appear in the first modified digital image. In an embodiment, for example, first two text colors appearing in the horizontal or vertical direction in the image (in order of scanning) are selected to appear in the first modified digital image. In another embodiment, for example, a random number generation technique is implemented to determine/select any text colors from the text colors contained in the first processed digital image. As an example, the first processed digital image 200 as shown in FIG. 2 contains six text colors cyan, red, olive, black, purple, and blue. A number is assigned to each text color (e.g., 1, 2, 3, 4, 5, and 6 to cyan, red, olive, black, purple, and blue respectively). A random number generator is then executed to generate random numbers. The output of the random number generator shall be limited to the total number of text colors contained in the document which is 6 in this case. If the random number generator generates 2 and 6, text colors shall be limited to red and blue only. With cyan, olive, black and purple being switched to red and/or blue. In an embodiment, the switching of colors may be done based on the spatial or color proximity of each of the text layers to red and blue as discussed in the later sections.

Once the text colors in the first processed digital image are limited to the desired number of text colors (as inputted in 302), the first modified digital image is generated. The OCR operation is then performed on the first modified digital image.

Figure 6:
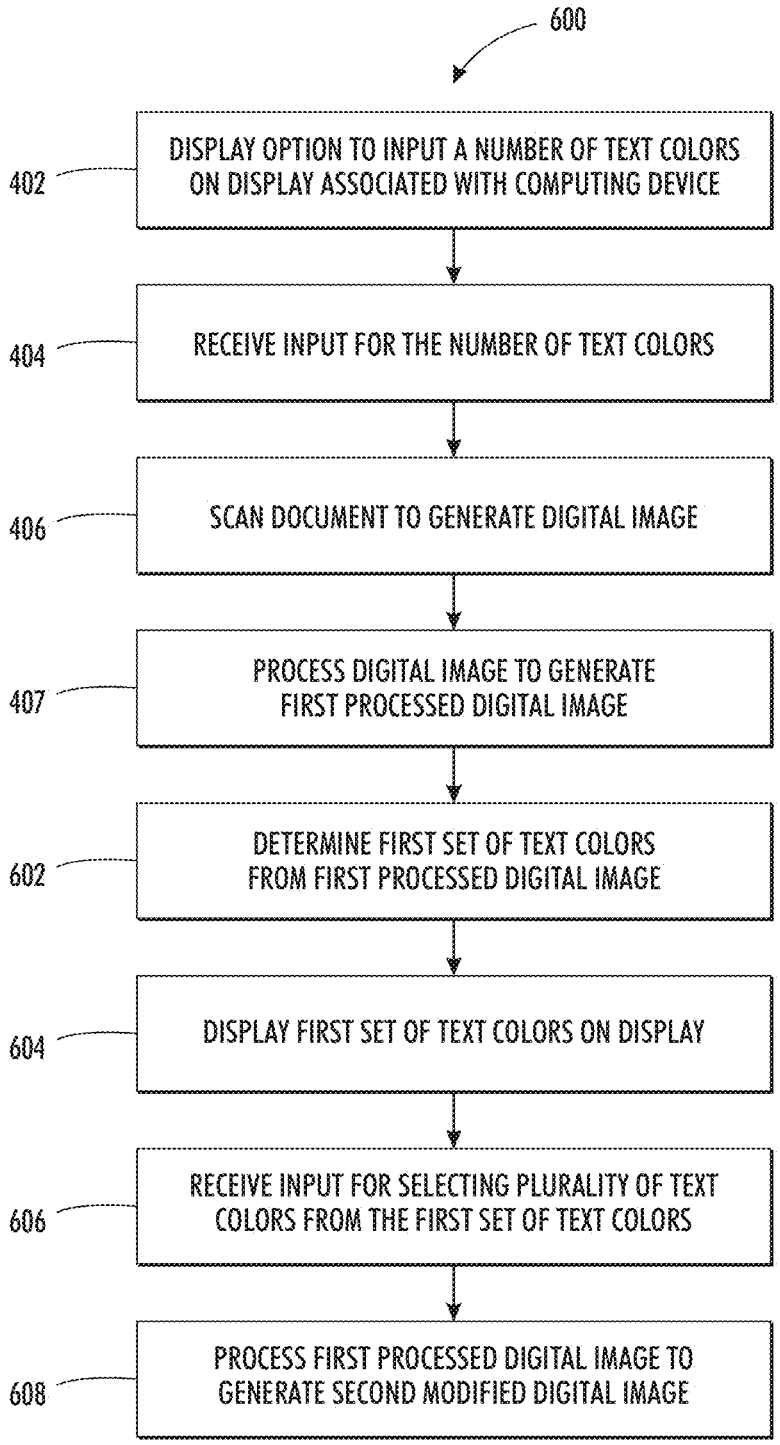
FIG. 6 is another flow diagram illustrating a method for modifying and limiting the number of text colors in a digital image in accordance with at least one embodiment.

FIG. 6 is another flow diagram 600 illustrating a method for modifying and limiting the number of text colors in the digital image in accordance with at least one embodiment. FIG. 6 is explained in conjunction with FIG. 4. The steps 402-407 are performed before step 602.

At step 602, the first set of text colors is determined from the first processed digital image. Once the first processed digital image is generated at step 407, the first set of text colors is determined from the first processed digital image.

At step 604, the first set of text colors is displayed. In an embodiment, the first set of text colors is displayed as the option 304 in various GUIs.

At step 606, an input for selecting a plurality of text colors from the first set of text colors is received. In an embodiment, the input for selecting a plurality of text colors is received from the user via various input mediums/techniques including, but not limited to, a keypad, mouse, joystick, any touch-sensitive medium, voice recognition, gestures, video recognition, and so forth.

At step 608, the first processed digital image (obtained from step 407) is further processed to generate a second modified digital image. The first processed digital image is further processed such that the second modified digital image includes only selected text colors from the first set of text colors (e.g., selected from the option 304). For example, if the user selects two text colors from the option 304, then the first processed digital image is further processed such that the second modified digital image contains text of only the selected text colors.

The first processing of the digital image includes performing various image processing operations on the scanned digital image such as filter, color space transformation, background adjustment, some text and pictorial separation operations including but not limited to the MRC operation (such as, the N-Layer MRC operation). The further processing of the first processed digital image includes the modification and limitation of the text colors contained in the original document to the desired/selected text colors.

Figure 7:
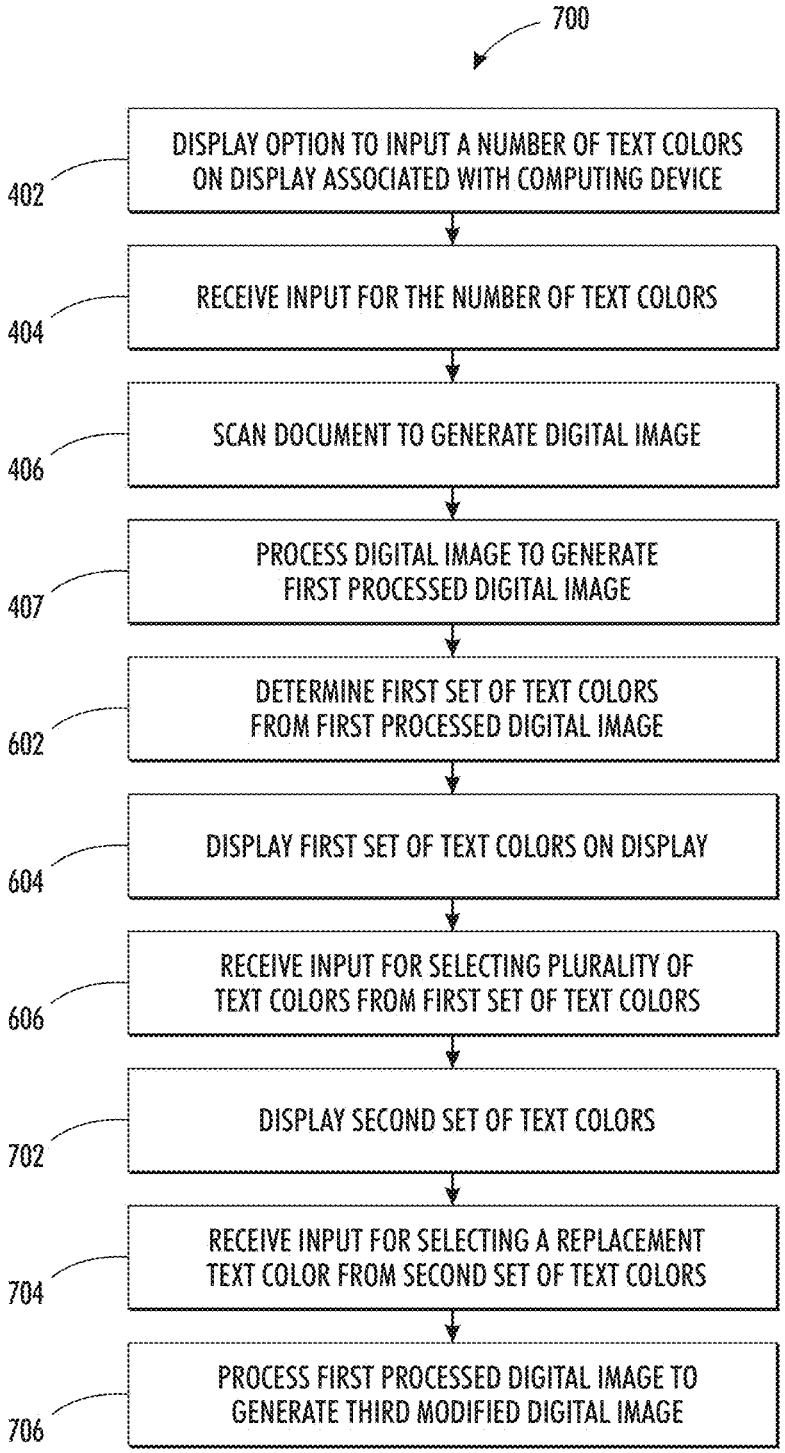
FIG. 7 is another flow diagram illustrating a method for modifying and limiting the number of text colors in a digital image in accordance with at least one embodiment.

FIG. 7 is another flow diagram 700 illustrating a method for modifying and limiting the number of text colors in the digital image in accordance with at least one embodiment. FIG. 7 is explained in conjunction with FIG. 4 and FIG. 6. The steps 402-407 and 602-606 are performed before step 702.

At step 702, a second set of text colors is displayed. In an embodiment, the second set of text colors is displayed as various replacement text color options (e.g., the replacement text color options 308, 312, and 316). In an embodiment, the second set of text colors includes text colors present in the first set of text colors. In another embodiment, the text colors in the second set of text colors are determined randomly. In another embodiment, the second set of text colors can either be a super set or subset of the first set of text colors, with or without some random additions. In an embodiment, the second set of text colors includes a white color.

At step 704, an input for selecting the replacement text color from the second set of text colors is received. In an embodiment, the input for selecting the replacement text color for one or more of the selected plurality of text colors from the option 304 is received from the user when the user selects the replacement text colors from the second set of text colors (e.g., from the replacement text color options 308, 312, and 316).

At step 706, the first processed digital image (obtained from step 407) is further processed to generate a third modified digital image. The further processing of the first processed digital image includes converting the one or more of the selected plurality of text colors in the original document to a corresponding defined replacement text color. Thus, the third modified digital image contains the selected replacement text colors and not the associated text color (where associated text colors are the ones selected from the option 304).

Figure 8:
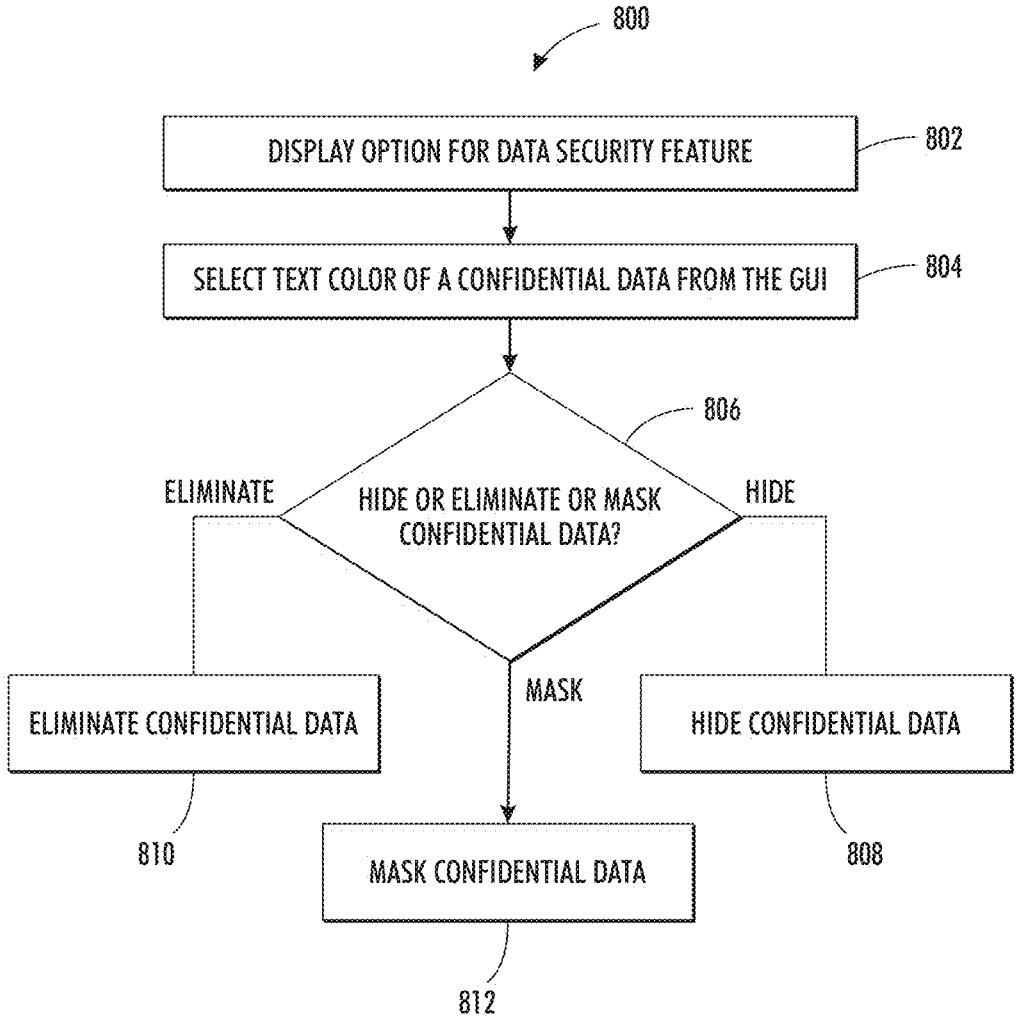
FIG. 8 is yet another flow diagram illustrating a method for facilitating a data security feature in accordance with at least one embodiment.

FIG. 8 is yet another flow diagram 800 illustrating a method for facilitating the data security feature in accordance with at least one embodiment. The data security feature enables the user to secure/protect any confidential data (e.g., bank account details, salary details, contact numbers, billing information, passport details, credit card numbers, social security numbers, and the like) contained in the document.

At step 802, an option for the data security feature is displayed. In an embodiment, the security option 320 is displayed in the GUI 300*f* to facilitate the data security feature. Once the security option 320 is activated, step 804 is executed.

At step 804, one or more text colors of the confidential data (in the first processed digital image corresponding to the document) are selected from the GUI 300*g*. In an embodiment, once the security option 320 is activated, the security text color selection option 322 appears in the GUI 300*g*. In an embodiment, the one or more text colors of the confidential data are selected from the security text color selection option 322 in the GUI 300*g* by the user. In another embodiment, the GUI 300*g* does not contain the security option 320. In this case, the step 802 can be avoided.

In an embodiment, the text colors to appear in the security text color selection option 322 are determined from the text colors present in the first processed digital image.

At step 806, it is determined whether to hide, eliminate, or mask the confidential data. In an embodiment, this is determined based on the activation of the options 326, 328, or 330. If the user activates the option 326 (i.e., opts to hide the confidential data), step 808 is followed.

At step 808, the confidential data is hidden. In an embodiment, in order to hide the confidential data, the text colors of text layers associated with the confidential data (e.g., the text colors selected from the security text color selection option 322) are made transparent.

In another embodiment, the background color in the first processed digital image is determined first. Thereafter, the text color of the confidential data is changed to the background color (i.e., the text color of the confidential data is made similar to the background color). In typical office documents, with white being the background, the same option is exercised by selecting white color or the background color from any of the replacement text color options 308, 312, and 316. For text on tint, the background color of the region where the text layer resides shall be determined to change the color of text to its local background color.

If the user clicks (i.e., activates) the option 328 (i.e., opts to eliminate the confidential data), step 810 is followed.

At step 810, the confidential data (i.e., the text layers with selected text colors from the security text color selection option 322) is eliminated/removed.

If the user clicks (i.e., activates) the option 330 (i.e., opts to mask the confidential data), step 812 is followed.

At step 812, the confidential data (i.e., the text layers with selected text colors from the security text color selection option 322) is masked. In an embodiment, in order to mask the confidential data, one or more color layers are inserted in the first processed digital image so as to cover the confidential data. In an embodiment, the confidential data is masked with a predefined color. In another embodiment, the confidential data is masked with background color. In yet another embodiment, the confidential data is masked with a user specified color. For example, an option (not shown) for selecting mask color may be provided in the GUI 300*g*.

In an embodiment, hiding the confidential data includes either masking of the confidential data or making the text color of the confidential data transparent or changing the text color of the confidential data to white or the background color. Thus, the masking of the confidential data may be a sub-feature of step 808 and hence the step 812 can be avoided. In an embodiment, when the user opts to hide the confidential data by selecting the option 326, various options for masking, making the text color transparent, changing the text color to white, and changing the text color to the background color are displayed (not shown in the GUI 300*g*) to the user. Based on the user's selection of a particular option the corresponding action will be performed.

Various steps of the methods described in FIG. 4, 6, 7, or 8 could be performed within a general-purpose computer, within MFD, or any other computing device.

Figure 9:
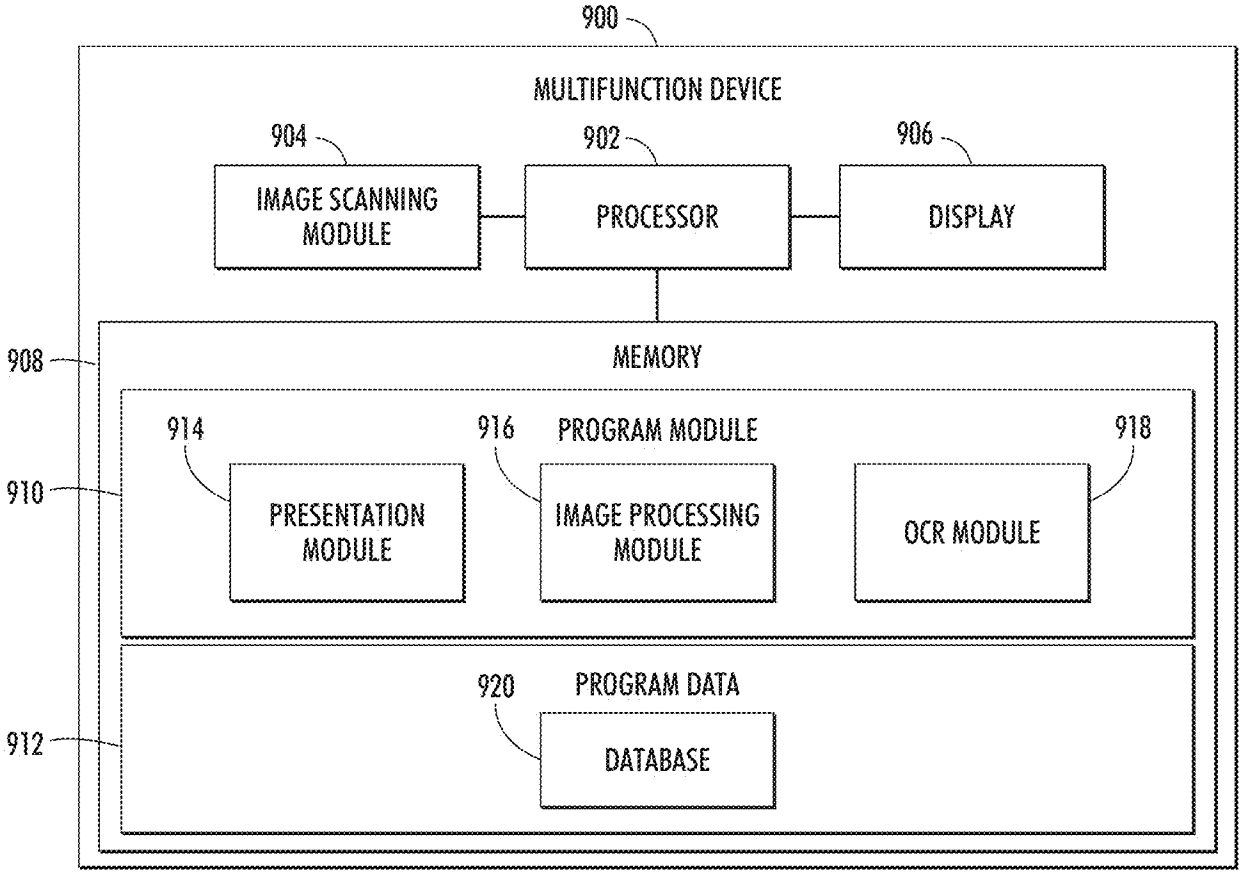
FIG. 9 is a block diagram illustrating an MFD in accordance with at least one embodiment.

FIG. 9 is a block diagram illustrating an MFD 104*c* in accordance with at least one embodiment. The MFD 104*c* includes a processor 902, an image-scanning module 904, a display 906, and a memory 908. The memory 908 includes a program module 910 and a program data 912. The program module 910 includes a presentation module 914, an image processing module 916, and an OCR module 918. The program data 912 includes a database 920. In an embodiment, the memory 908 and the image-scanning module 904 function under the control of the processor 902.

The processor 902 is coupled to the image-scanning module 904, the display 906, one or more input mediums (not shown), and the memory 908. The processor 902 executes a set of instructions stored in the memory 908 to perform one or more operations on the MFD 104*c*. The processor 902 can be realized through a number of processor technologies known in the art. Examples of the processor 902 include, but are not limited to, an X86 processor, a RISC processor, an ASIC processor, a CISC processor, or any other processor. In an embodiment, the processor 902 includes a Graphics Processing Unit (GPU) that executes the set of instructions to perform one or more image processing operations.

In an embodiment, the image-scanning module 904 is capable of scanning documents to generate corresponding digital images. The image-scanning module 904 implements various CCD devices and/or CMOS devices to capture the digital image. In an embodiment, the image-scanning module 904 implements a linear scanning technique. In another embodiment, the image-scanning module 904 implements a two-dimensional scanning technique. Once the scanning is completed, the image-scanning module 904 stores the digital image (e.g., the scanned document) in the database 920.

The display 906 facilitates the display of the GUIs (300*a*-300*g*) and interaction with the MFD 104*c* in conjunction with the mediums. The display 906 can be realized through several known technologies, such as, Cathode Ray Tube (CRT) based display, Liquid Crystal Display (LCD), Light Emitting Diode (LED)-based display, Organic LED display technology, and Retina Display technology. Further, the display 906 can be a touch-screen capable of receiving user inputs.

The memory 908 stores a set of instructions and data. Some of the commonly known memory implementations can be, but are not limited to, a Random Access Memory (RAM), Read Only Memory (ROM), Hard Disk Drive (HDD), and a secure digital (SD) card. The program module 910 includes a set of instructions that are executable by the processor 902 to perform specific actions on the MFD 104*c*. It is understood by a person having ordinary skills in the art that the set of instructions are stored in the memory 908 in conjunction with various hardware of the MFD 104*c* to perform various operations.

The presentation module 914 facilitates the presentation of the various GUIs (300*a*-300*g*) on the display 906 under the control of the processor 902. In an embodiment, various data (i.e., text to be displayed in any GUI) and objects (e.g., text boxes, drop-down lists, radio buttons, or various scales), and information related to positioning of the data and object for generating the GUIs (300*a*-300*g*) are stored in the database 920. The presentation module 914 determines appropriate the GUIs (300*a*-300*g*) based on the user inputs.

The image processing module 916 includes a set of instructions which when executed by the processor 902 varies one or more properties associated with the digital image. The image processing module 916 obtains the digital image from the database 920. Thereafter, the image processing module 916 performs a first processing operation on the digital image based on various inputs coming from 906 such as filter, color space transformation, changing of image contrast, text/pictorial separation, compression, etc., and generates a first processed digital image. In an embodiment, in order to identify various texts in the digital image, the image processing module 916 implements the MRC technique (such as, the N-Layer MRC operation) on the scanned digital image to generate the first processed digital image. Based on the MRC technique, the image processing module extracts the text with different text colors into separate planes. This also facilitates the identification of text colors (e.g., the first set of text colors) and the background color. In another embodiment, the image processing module 916 implements any other suitable text extraction technique to obtain the first processed digital image. Thereafter, the image processing module 916 stores the first set of text colors and the background color in the database 920. In an embodiment, the background color is determined using various techniques including but not limited to histogram analysis, peak determination technique, or the like. The image processing module 916 further processes the first processed digital image and varies one or more properties of this image, such as text colors in the first processed digital image.

In an embodiment, when the user defines the number of text colors in the appropriate GUIs (300*a*-300*g*), the image processing module 916 further processes the first processed digital image to generate the first modified digital image. During this processing, the image processing module 916 restricts the number of text colors to the defined number to obtain the first modified digital image.

In an embodiment, in order to determine the text colors to appear in the first modified digital image, the image processing module 916 implements the histogram technique. This is further explained in the description supra.

In another embodiment, the image processing module 916 replaces other text colors by the selected text colors from the option 304 in the GUI 300*b* or the GUI 300*c* to generate the second modified digital image. Thus the second modified digital images include only the selected text colors from the option 304 in the GUI 300*b* or the GUI 300*c*.

In another embodiment, the image processing module 916 replaces the selected text color from the option 304 with the selected replacement text color from the various replacement text color options (308, 312, or 316) to generate the third modified digital image.

In various embodiments, in order to modify the text colors, the image processing module 916 utilizes the output of the MRC operation (e.g., various layers/planes). The image processing module 916, modifies the color of a text layer corresponding to the text color to be replaced (i.e., the text color selected from the option 304 using the GUI 300*d* or 300*e*) to the selected text color (i.e., the corresponding text color selected from the option 304, the replacement text color options 308, 312, or 316 using the GUI 300*b*, 300*c*, and 300*e*; or the text color determined based on the histogram analysis). For example, if the user input is received via the GUI 300*a*, the colors to appear in the modified digital image may be determined using the histogram analysis (e.g., cyan and black). Then, the image processing module 916 replaces/modifies the color of the text layers associated with other text colors (i.e., after applying MRC method) with cyan and black (i.e., the text colors identified based on the histogram analysis). Thus, only cyan and black text colors appear in the modified digital image.

In an embodiment, the image processing module 916 implements a spatial proximity based technique in conjunction with the histogram analysis to determine the replacement text colors. For example, based on the histogram analysis, red text color will be replaced by black if the chrominance and luminance values of red color are a closer match to black. In another example, red color will be replaced with cyan color based on its spatial proximity to cyan as shown in 200. Similarly, based on spatial proximity, olive and purple will be replaced with black. Whereas blue color will be changed to cyan.

Similarly, for example, if the user selects text colors using the option 304 (in the GUIs 300*b* or 300*c*) to appear in the modified digital image, then the color of the text layers corresponding to the remaining text colors (other than the selected from the option 304) are modified to the selected text colors. Further, the similar technique is also used to replace the selected text colors from various other GUIs.

In order to facilitate the data security feature, the image processing module 916 hides, removes, or masks the selected text color (from the option 304) to generate a fourth modified digital image.

If the user opts to hide the confidential data (i.e., by selecting/activating the option 326), in an embodiment, the image processing module 916 sets the transparency value to 100% for the color layers associated with the selected text colors in the MRC output. Thus, the fourth modified digital image with hidden confidential data is obtained.

If the user opts to hide the confidential data (i.e., by selecting/activating the option 326), in another embodiment, the image processing module 916 modifies text color of the text layers corresponding to the text color selection for the confidential data (i.e., text color selected from the security text color selection option 322) to the background color of that text layer. Thus, the fourth modified digital image with hidden confidential data is obtained.

If the user opts to eliminate the confidential data (i.e., by selecting/activating the option 328), the image processing module 916 removes all elements of the text layers corresponding to the selected text colors (e.g., the text color of the confidential data from the security text color selection option 322) from the MRC output. Thus, the fourth modified digital image with no confidential data is obtained.

If the user opts to mask the confidential data (i.e., by selecting/activating the option 330), the image processing module 916 inserts a color layer such that the newly inserted color layer covers the confidential data. Thus, the fourth modified digital image with confidential data masked under some color is obtained. In an embodiment, the confidential data is masked with a predefined color. In another embodiment, the confidential data is masked with background color. In yet another embodiment, the confidential data is masked with a user specified color. For example, an option (not shown) for selecting mask color may be provided in the GUI 300*g*.

Once the modified digital image (e.g., the first modified digital image, the second modified digital image, the third modified digital image, or the fourth modified digital image) is generated, the image processing module 916 stores the modified digital image in the database 920.

In an embodiment, the modified digital image can be printed using a printing module (not shown) of the MFD 104*c*. In another embodiment, the modified digital image can be faxed to any computing device (i.e., a computing device capable of receiving the facsimile) using a facsimile module (not shown) of the MFD 104*c*.

In another embodiment, the data security feature option can be extended to copy, print, fax, scan and all other image path services as available on the MFDs. In yet another embodiment, color modification option and the data security feature can be extended to various other services as available on any of the computing devices in 104.

In another embodiment, the OCR module 918 obtains the modified digital image from the database 920. The OCR module 918 then performs an OCR operation to recognize the text in the modified digital image. The input and output of the OCR module thus contain the text colors present in the modified digital image.

The database 920 is a storage device that stores the data submitted from and/or required by the image-scanning module 904, the presentation module 914, the image processing module 916, and the OCR module 918. In an embodiment, the database 920 can be implemented using technologies including, but not limited to Oracle®, IBM DB2®, Microsoft SQL Server®, Microsoft Access®, PostgreSQL®, MySQL® and SQLite®, and the like.

The disclosed methods and systems, as illustrated in the ongoing description or any of its components, may be embodied in the form of a computer system. Typical examples of a computer system include a general-purpose computer, a programmed microprocessor, a micro-controller, a peripheral integrated circuit element, and other devices, or arrangements of devices that are capable of implementing the steps that constitute the method of the disclosure.

The computer system comprises a computer, an input device, a display unit and the Internet. The computer further comprises a microprocessor. The microprocessor is connected to a communication bus. The computer also includes a memory. The memory may be Random Access Memory (RAM) or Read Only Memory (ROM). The computer system further comprises a storage device, which may be a hard-disk drive or a removable storage drive, such as, a floppy-disk drive, optical-disk drive, etc. The storage device may also be a means for loading computer programs or other instructions into the computer system. The computer system also includes a communication unit. The communication unit allows the computer to connect to other databases and the Internet through an Input/output (I/O) interface, allowing the transfer as well as reception of data from other databases. The communication unit may include a modem, an Ethernet card, or other similar devices, which enable the computer system to connect to databases and networks, such as, LAN, MAN, WAN, and the Internet. The computer system facilitates inputs from a user through input device, accessible to the system through an I/O interface.

The computer system executes a set of instructions that are stored in one or more storage elements, in order to process input data. The storage elements may also hold data or other information, as desired. The storage element may be in the form of an information source or a physical memory element present in the processing machine.

The programmable or computer-readable instructions may include various commands that instruct the processing machine to perform specific tasks such as steps that constitute the method of the disclosure. The method and systems described can also be implemented using only software programming or hardware or by a varying combination of the two techniques. The disclosure is independent of the programming language and the operating system used in the computers. The instructions for the disclosure can be written in all programming languages including, but not limited to, 'C', 'C++', 'Visual C++', and 'Visual Basic'. Further, the software may be in the form of a collection of separate programs, a program module containing a larger program or a portion of a program module, as discussed in the ongoing description. The software may also include modular programming in the form of object-oriented programming. The processing of input data by the processing machine may be in response to user commands, results of previous processing, or a request made by another processing machine. The disclosure can also be implemented in all operating systems and platforms including, but not limited to, 'Unix', 'DOS', 'Android', 'Symbian', and 'Linux'.

The programmable instructions can be stored and transmitted on a computer-readable medium. The disclosure can also be embodied in a computer program product comprising a computer-readable medium, or with any product capable of implementing the above methods and systems, or the numerous possible variations thereof.

The method, system, and computer program product, as described above, have numerous advantages. Some of these advantages may include, but are not limited to, obtaining better OCR accuracy with minimization in customer complaints. By providing various options for defining number of text colors and/or for selecting text colors to appear in the modified digital image, the customers will not be surprised at the change in the text colors. Thus, subsequent complaints due to undesired text color changes at the cost of improved OCR accuracy can be minimized. In one embodiment, the layers of similar text colors can be lumped together as part of further processing of first processed digital image to generate a fifth modified digital image resulting in a reduced number of text layers. With a reduced number of text layers, the MRC output will yield a higher compression ratio. Thus, the file size of the modified digital image can be lowered. Further, the data security feature helps protect any confidential data by hiding or eliminating the confidential data.

Various embodiments of the GUIs, methods, and systems for facilitating modifications in the text colors in digital images have been disclosed. However, it should be apparent to those skilled in the art that many more modifications, besides those described, are possible without departing from the inventive concepts herein. The embodiments, therefore, are not to be restricted, except in the spirit of the disclosure. Moreover, in interpreting the disclosure, all terms should be understood in the broadest possible manner consistent with the context. In particular, the terms "comprises" and "comprising" should be interpreted as referring to elements, components, or steps, in a non-exclusive manner, indicating that the referenced elements, components, or steps may be present, or utilized, or combined with other elements, components, or steps that are not expressly referenced.

A person having ordinary skills in the art will appreciate that the system, modules, and sub-modules have been illustrated and explained to serve as examples and should not be considered limiting in any manner. It will be further appreciated that the variants of the above-disclosed system elements, or modules and other features and functions, or alternatives thereof, may be combined to create many other different systems or applications.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented using a wide variety of suitable processes and system modules and are not limited to any particular computer hardware, software, middleware, firmware, microcode, etc.

The claims can encompass embodiments for hardware, software, or a combination thereof.

It will be appreciated that variants of the above disclosed, and other features and functions or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method for facilitating modification of text colors in a digital image, the method comprising:

determining, by a processor, a first set of text colors from the digital image, wherein the first set of text colors are determined based on colors of text in the digital image and the text of the digital image is extracted into a plurality of layers based on color and spatial proximity;

displaying, by the processor, the first set of text colors on a display associated with a computing device;

receiving, by the processor, an input for selecting a plurality of colors from the first set of text colors;

displaying, by the processor, a second set of text colors on the display in response to the selection of the plurality of colors, wherein the second set of text colors corresponding to each of the selected text color comprise a set of replacement text colors;

receiving, by the processor, an input for selecting a replacement text color, from the set of replacement text colors, for each of the selected plurality of colors;

converting, by the processor, text color that comprises one or more of the selected plurality of colors to corresponding selected replacement text color based on the extracted layers;

generating, by the processor, a modified digital image based on the converting; and performing optical character recognition (OCR) on the modified digital image, wherein the number of text colors for text that undergoes OCR of the modified digital image is less than the number of text colors of the digital image.

* * * * *